US007351322B2

(12) United States Patent
Hiraiwa et al.

(10) Patent No.: US 7,351,322 B2
(45) Date of Patent: Apr. 1, 2008

(54) FLUORINE GAS GENERATOR AND METHOD OF ELECTROLYTIC BATH LIQUID LEVEL CONTROL

(75) Inventors: Jiro Hiraiwa, Osaka (JP); Osamu Yoshimoto, Osaka (JP); Tetsuro Tojo, Osaka (JP)

(73) Assignee: Toyo Tanso Co., Ltd., Osaka (JP)

( * ) Notice: Subject to any disclaimer, the term of this patent is extended or adjusted under 35 U.S.C. 154(b) by 149 days.

(21) Appl. No.: 10/702,654

(22) Filed: Nov. 7, 2003

(65) Prior Publication Data

US 2004/0099537 A1 May 27, 2004

(30) Foreign Application Priority Data

Nov. 8, 2002 (JP) ..... 2002-324759

(51) Int. Cl.
*C25B 9/00* (2006.01)
*C25B 1/24* (2006.01)

(52) U.S. Cl. ..... 205/411; 205/619; 204/246; 204/247

(58) Field of Classification Search ..... 205/411, 205/82, 619; 204/246, 247
See application file for complete search history.

(56) References Cited

U.S. PATENT DOCUMENTS 3,860,504 A * 1/1975 Kaudewitz et al. ..... 205/411
5,688,384 A 11/1997 Hodgson et al.
5,690,797 A * 11/1997 Harada et al. ..... 204/228.5
6,303,009 B1 * 10/2001 Bossard ..... 204/228.4
6,818,105 B2 * 11/2004 Tojo et al. ..... 204/240
2003/0183179 A1 * 10/2003 Lin ..... 123/2
2004/0007457 A1 * 1/2004 Tojo et al. ..... 204/247

FOREIGN PATENT DOCUMENTS

| | | |
|---|---|---|
| CN | 1137808 | 12/1996 |
| EP | 1283280 | 6/2001 |
| JP | 2-232386 | 9/1990 |
| JP | H02-232386 | 9/1990 |
| JP | HO9-505853 | 6/1997 |
| JP | 2002-339090 | 11/2002 |
| WO | WO96/08589 | 3/1996 |
| WO | WO2001/077412 | 10/2001 |

* cited by examiner

*Primary Examiner*—Harry D. Wilkins, III
*Assistant Examiner*—Nicholas A. Smith
(74) *Attorney, Agent, or Firm*—Oblon, Spivak, McClelland, Maier, & Neustadt, P.C.

(57) ABSTRACT

A fluorine gas generator for generating fluorine gas by electrolysis of an electrolytic bath comprising a hydrogen fluoride-containing mixed molten salt in which generator the position of the electrolytic bath liquid surface in the electrolytic cell can be safely controlled even during suspension of electrolysis therein is provided. The generator comprises an anode chamber and a cathode chamber separated from each other by a partition wall and is provided with electrolytic bath liquid level controlling means for controlling the electrolytic bath liquid level in at least one of the anode chamber and cathode chamber during suspension of fluorine gas generation.

2 Claims, 3 Drawing Sheets

S1 : Suspension of fluorine gas generation

S2 : Detection of pressure drop in anode chamber

S3 : Start of weak electric current supply to anode

S4 : Detection of normal pressure in anode chamber

S5 : Stoppage of weak electric current supply to anode

FLUORINE GAS GENERATOR AND METHOD OF ELECTROLYTIC BATH LIQUID LEVEL CONTROL

BACKGROUND OF THE INVENTION

1. Field of the Invention

The present invention relates to a fluorine gas generator, in particular a fluorine gas generator capable of generating high-purity fluorine gas having very low impurity content and suited for use in the process of manufacturing semiconductors, among others.

2. Description of the Relating Art

Conventionally, fluorine gas is one of the key gases essential in the field of semiconductor production, for instance. While it is used as such in certain instances, the demand for nitrogen trifluoride gas (hereinafter referred to as "$NF_3$ gas") and like gases synthesized based on fluorine gas and intended for use as cleaning gases or dry etching gases in semiconductor manufacturing apparatus has been rapidly increasing. Further, neon fluoride gas (hereinafter referred to as "NeF gas"), argon fluoride gas (hereinafter referred to as "ArF gas"), krypton fluoride gas (hereinafter referred to as "KrF gas") and the like are excimer laser oscillation gases used in patterning of integrated semiconductor circuits, and the raw materials thereof used in many cases are mixed gases composed of a rare gas and gaseous fluorine.

The fluorine gas or $NF_3$ gas for use in the manufacture of semiconductors and the like is required to be highly pure with the impurity content as low as possible. On the sites of semiconductor manufacture, for instance, necessary amounts of fluorine gas are taken out of gas cylinders filled with fluorine gas. It thus becomes very important to secure sites for storing such cylinders, store the gas safely, maintain the purity of the gas, and manage for such purposes. As for $NF_3$ gas, for which the demand has been rapidly increasing lately, the demand tends to exceed the supply, hence there arises a problem that certain amounts of the gas should be in stock. Further, $NF_3$ gas has been changed into fluorine gas for the global warming. In view of these, to have a fluorine gas generator or producer of the on-demand and on-site type at the site of use thereof is preferred to handling high-pressure fluorine gas storing such cylinders.

Conventionally, fluorine gas is produced in an electrolytic cell such as shown in FIG. 3. The electrolytic cell body 201 is generally made of Ni, Monel, carbon steel or the like. Further, in case that the bottom of the electrolytic cell body serves as cathode 201, a bottom plate 212 made of polytetrafluoroethylene or the like having electric insulating and corrosion resistant property is disposed for preventing the hydrogen gas and fluorine gas generated from being mixed with each other. The electrolytic cell body 201 is filled with an electrolytic bath 202, namely a potassium fluoride-hydrogen fluoride system (hereinafter referred to as "KF-HF system") in the form of a mixed molten salt. The cell or bath is divided into an anode chamber or compartment 210 and a cathode chamber or compartment 211 by means of a skirt 209 made of Monel or the like. Upon applying a voltage between a carbon or nickel (hereinafter referred to as "Ni") anode 203 contained in the anode chamber 210 and a Ni or iron cathode 204 contained in the cathode chamber 211, electrolysis occurs and fluorine gas is generated. The fluorine gas generated in the anode chamber 210 is discharged through a product line 208, while the hydrogen gas generated in the cathode chamber 211 is discharged through a hydrogen gas discharge line 207 (cf. e.g. Patent Document 1: Laid-open Japanese Patent Application (J P Kohyo) H09-505853).

However, when electrolysis is interrupted in the prior art fluorine gas generators, current supply between anode 203 and cathode 204 is stopped, and the fluorine gas remaining in the anode chamber 210 is then adsorbed into the anode 203, with the result that the pressure in the anode chamber 210 drops. This phenomenon occurs more remarkably in cases where the anode 203 is made of carbon. The problem is that when the pressure within the anode chamber 210 drops, not only the electrolytic bath liquid level in the anode chamber 210 rises, the liquid level in the cathode chamber drops, but the condition of liquid level in anode chamber 210 and cathode chamber 211 is uneven and the electrolysis restarting condition is unstable. In the worst case, hydrogen gas generated goes below the partition wall 209 and mixed with fluorine gas and explodes.

Accordingly, it is an object of the present invention, which has been made in view of the above problems, to provide a fluorine gas generator in which the fluorine gas discharge port disposed in the anode chamber of the fluorine gas generator can be closed and the electrolytic bath liquid level in the elocrtolyzer can be controlled even during the period of suspension of fluorine gas generation.

SUMMARY OF THE INVENTION

The above object is accomplished by providing, in accordance with the present invention, a fluorine gas generator for generating fluorine gas by electrolyzing an electrolytic bath comprising a hydrogen fluoride-containing mixed molten salt which generator comprises, according to this invention, an anode chamber or compartment and a cathode chamber or compartment separated from each other by a partition wall and is provided with electrolytic bath liquid level controlling means for controlling a height of electrolytic bath liquid level in at least one of the anode chamber and the cathode chamber during suspension of fluorine gas generation.

According to this constitution, after interruption of fluorine gas generation from the fluorine gas generator, namely stop supplying the current between anode and cathode, during suspension of fluorine gas generation at the time of closure of the fluorine gas discharge port disposed in the anode chamber of the electrolyzer, it becomes possible to control the readsorption in the pores of carbon anode of the fluorine gas remaining in the electrolyzer. As a result it becomes possible to control the phenomenon of rising the electrolytic bath liquid level. The restarting condition of electrolysis can be stable. Therefore the gas generated does not go below the partition wall and prevent the explosion by mixing generated fluorine gas and hydrogen gas. The expression "during suspension or interruption of fluorine gas generation" as used herein means the state of suspension of fluorine gas generation the supply of the main electrolysis electric current applied between both the anode and cathode electrodes during a period in which there is no need of fluorine gas generation and discharging.

In an other embodiment this invention, the electrolytic bath liquid level controlling means in the fluorine gas generator according to this invention comprises pressure sensing means and pressure controlling means operated in association with the pressure sensing means.

This constitution makes it possible to accurately detect, either directly or indirectly, pressure changes in the anode chamber, which are one of the causes of changes in the difference of the electrolytic bath liquid level. As a result, it becomes possible to close the fluorine gas discharge port disposed in the anode chamber of the electrolyzer and control the difference of electrolytic bath liquid level between anode chamber and cathode chamber in the electrolyzer even during suspension of fluorine gas generation. Therefore, the restart of electrolysis will not become impossible due to rising of the electrolytic bath liquid level. As a result, the gas generated does not go below the partition wall and prevent the explosion by mixing generated fluorine gas and hydrogen gas.

In the other embodiment according to this invention, the fluorine gas generator, wherein the electrolytic bath liquid level controlling means for controlling the liquid level in the anode chamber comprises a pressure sensing means, and a pressure controlling means operated in association with the pressure sensing means and controlling the pressure in the anode chamber to control the difference of the liquid level in the anode chamber and the cathode chamber by supplying a suitable current between anode and cathode.

This constitution makes it possible to make pressure adjustments with ease in electrolyzers having the existing constitution even during suspension of fluorine gas generation as a result of closure of the fluorine gas discharge port disposed in the anode chamber of the fluorine gas generator electrolyzer. The current supplying between anode and cathode is preferably of 0.1-5 $A/dm^2$ and 0.5-2 $A/dm^2$ is more preferable, for instance. At this time, current supplying can be provided from main electrolysis source or sub-source.

The method of controlling the electrolytic bath liquid level in a fluorine gas generator as defined herein is a method of controlling the electrolytic bath liquid level in the fluorine gas generator having an anode chamber and a cathode chamber separated from each other by a partition wall for generating fluorine gas by electrolyzing an electrolytic bath comprising a hydrogen fluoride-containing mixed molten salt and characterized in that the pressure in at least one of the anode chamber and the cathode chamber during suspension of fluorine gas generation is detected by a pressure sensing means and, according to the result of detection by the pressure sensing means, a weak electric current is supplied to the anode for generation of a slight amount of fluorine gas to thereby adjust the pressure in the anode chamber and to control the difference of the electrolytic bath liquid level in the anode chamber and cathode chamber and maintain the electrolytic bath liquid level at a constant level. Further the restarting condition of electrolysis can be stable.

This constitution makes it possible to detect the changes in electrolytic bath liquid level through direct or indirect detection of the pressure changes in the anode chamber, which may cause changes in electrolytic bath liquid level, and, accordingly, control the electrolytic bath liquid level in the electrolyzer even during suspension of electrolysis in the fluorine gas generator, without the restart of electrolysis becoming impossible due to rising of the electrolytic bath liquid level. Therefore, the generated gas does not go below the partition wall and prevent the explosion by mixing generated fluorine gas and hydrogen gas.

Figure 1:
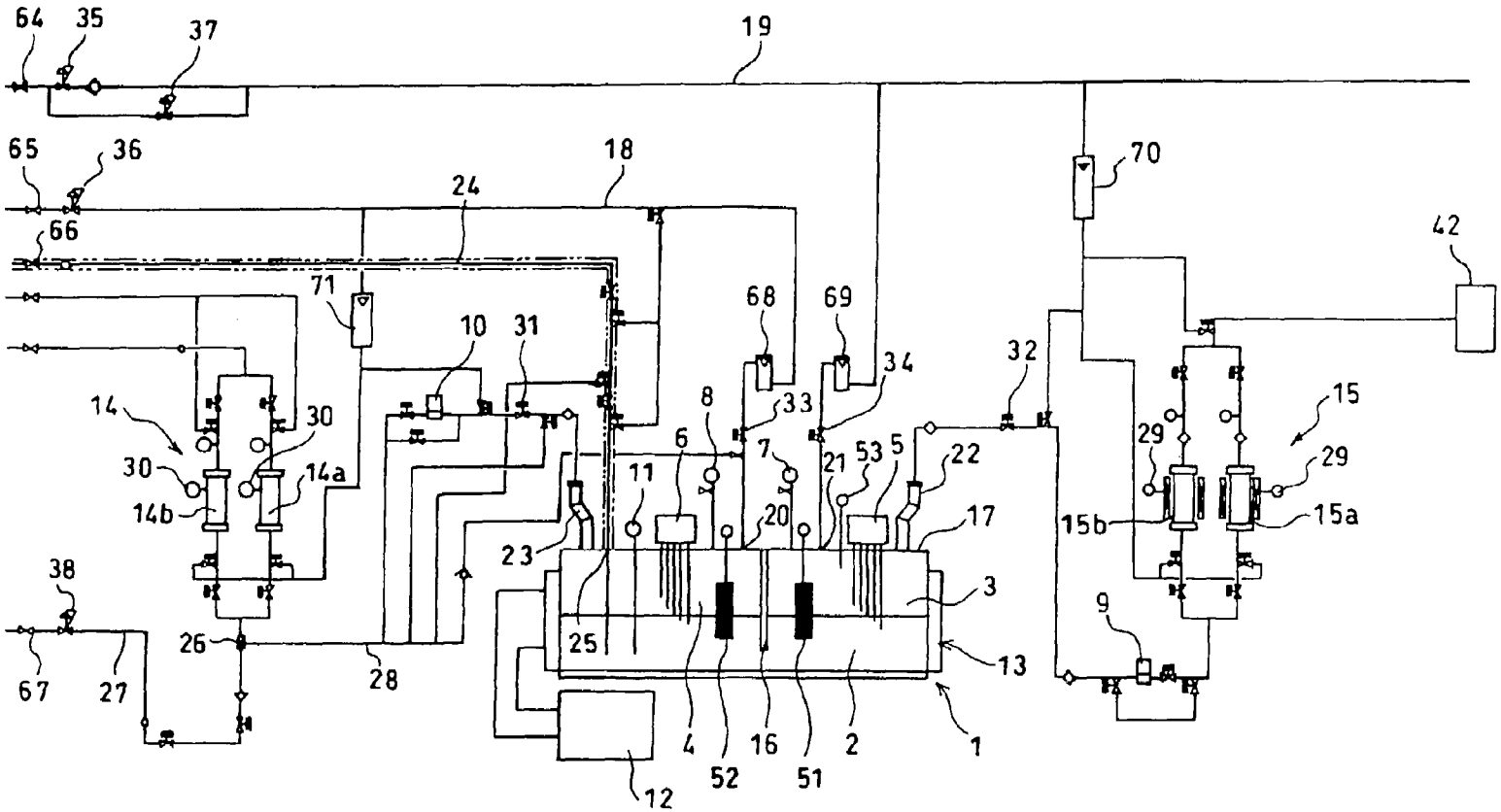
FIG. 1 is a schematic representation of the principal section of the fluorine gas generator according to the invention.

In the figures, 1 stands for an electrolytic cell or electrolyzer, 2 for an electrolytic bath, 3 for an anode chamber, 4 for a cathode chamber, 5 for a first level sensing means, 6 for a second level sensing means, 7 and 8 each for a pressure gauge, 9 and 10 each for a automatic valve, 11 for a thermometer, 12 for a warm water heater, 13 for a warm water jacket, 14 for an HF remover, 15 for an HF remover, 16 for a partition wall, 17 for an upper covering, 18 and 19 each for a gas line, 20 and 21 each for a purge gas inlet/outlet, 22 and 23 each for a gas outlet port, 24 for an HF feed line, 25 for an HF introduction port, 26 for a pressure reducing means, 27 and 28 each for a gas line, 29 and 30 each for a pressure gauge, 31 to 34 each for an automatic valve, 64 to 67 each for a manual valve, 68 to 71 each for a flowmeter, 51 for an anode and 52 for a cathode.

DETAILED DESCRIPTION OF THE PREFERRED EMBODIMENTS

Now, referring to the drawings, an embodiment of the fluorine gas generator according to the invention is described.

FIG. 1 is a schematic representation of the principal parts of a fluorine gas generator according to the invention. In FIG. 1, 1 is an electrolytic cell, 2 is an electrolytic bath consisting of a mixed fused or molten KF-HF system-based salt, 3 is an anode chamber, 4 is a cathode chamber, 5 is a first level sensing means for detecting the level of the electrolytic bath 2 in the anode chamber 3 at 5 level stages, 6 is a second level sensing means for detecting the liquid level in the cathode chamber 4 at 5 level stages. Further, 7 is a pressure gauge for measuring the pressure in the anode chamber 3, and 8 is a pressure gauge for measuring the pressure in the cathode chamber 4. And, 9 and 10 are automatic valves opened or closed in association with the pressures measured by the pressure gauges 7 and 8. Further, 11 is a thermometer for measuring the temperature of the electrolytic bath 2, and 12 is a warm water heater for controlling a warm water jacket 13 disposed around the side faces and bottom of the electrolytic cell 1 according to the signals from the thermometer 11. 14 is a remover for removing HF gas in the hydrogen-HF mixed gas discharged from the cathode chamber 4, and 15 is an HF remover packed with NaF, for instance, for removing HF gas in the $F_2$—HF mixed gas discharged from the anode chamber 3 to thereby discharge highly pure fluorine gas alone. 51 is an anode, and 52 is a cathode. 53 is a pressure gauge for measuring the pressure in the anode chamber 3 for the purpose of controlling the electrolytic bath liquid level during suspension of electrolysis.

The electrolytic cell 1 is made of such a metal or alloy as Ni, Monel, pure iron or stainless steel. The electrolytic cell 1 is divided into the anode chamber 3 and cathode chamber 4 by means of a partition wall 16 made of Ni or Monel. Within the anode chamber 3, there is disposed the anode 51. In the cathode chamber 4, there is disposed the cathode 52. Preferably used as the anode 51 is a low-polarizable carbon electrode. The cathode 52 is preferably made of Ni or iron. The upper covering 17 of the electrolytic cell 1 has inlets/outlets 21, 20 for a purge gas from gas lines 18, 19, which are constituent elements of the pressure maintenance means for maintaining the anode chamber 3 inside and cathode chamber 4 inside at atmospheric pressure, an outlet port 22 for the fluorine gas generated in the anode chamber 3, and an outlet port 23 for the hydrogen gas generated in the cathode chamber 4. The upper covering 17 is also provided with an inlet 25 for introducing HF from an HF feeding line 24 when the level of the electrolytic bath 2 descends, together with the first level sensing means 5 and second level sensing means 6 for detecting the liquid levels in the anode chamber 3 and cathode chamber 4, respectively, and the pressure gauges 7 and 8.

The electrolytic cell 1 is further provided with a temperature adjusting means for heating the inside of the electrolytic cell 1. The temperature adjusting means is constituted of the warm water jacket 13 disposed around the electrolytic cell 1 in close contact therewith, the warm water heating device 12 connected with the warm water jacket 13 and capable of conventional PID control, and the thermometer 11, for example a thermocouple, disposed in either one of the anode chamber 3 and cathode chamber 4, and thus controls the temperature in the electrolytic cell 1. It is also possible to dispose a heat insulating material around the warm water jacket 13. The warm water jacket 13 may be of the ribbon type or nichrome wire type, for instance, and the shape thereof is not particularly restricted but preferably is such that the electrolytic cell 1 is wholly surrounded thereby.

The pressure maintenance means for maintaining the inside of the anode chamber 3 and cathode chamber 4 at purpose pressure comprises automatic valves 9, 10 operated for passing or shutting a pressurizing gas from a gas cylinder according to the results of pressure gauges 7, 8 for measuring the pressures in the anode chamber 3 and cathode chamber 4, respectively, automatic valves 31-34 operated according to the results of sensing of the liquid levels of the electrolytic bath 2 by the first level sensing means 5 and second level sensing means 6 to feed or discharge the gas to or from the anode chamber 3 or/and cathode chamber 4, respectively, manual valves 64-67 operated for opening or shutting the gas lines 18, 19, etc. of this pressure maintenance means, and flowmeters 68-71 capable of adjusting the gas flow rates in the gas lines to respective appropriate rates in advance. The automatic valves 31-34 are preferably of the air actuator type so that almost operating heat is generated, resulting in suppressing corrosion of valves. Thus, the effects on the gas lines can be reduced. This pressure maintenance means maintains the purpose pressure in the anode chamber 3 and cathode chamber 4. As a result, the fluctuations in electrolysis conditions are small, hence the electrolysis can be carried out stably. The fluorine gas and hydrogen gas formed upon electrolysis are discharged, in a forced-out manner, from the electrolytic cell 1 through the outlets 22, 23.

The gas to be fed to the electrolytic cell 1 connected with the pressure maintenance means is not particularly restricted but may be any inert gas. When, for example, at least one of rare gases such as Ar gas, Ne gas, Kr gas and Xe gas is used, a mixed gas composed of fluorine gas and such a rare gas can be easily obtained in an arbitrary mixing ratio. In this way, it becomes possible to use the mixed gas, for example, as a radiation source for excimer laser oscillation in patterning integrated circuits in the field of semiconductor manufacture. By disposing the fluorine gas generator of the invention on a production line in the field of semiconductor manufacture, it becomes possible to feed a mixing gas such as fluorine gas or rare gas on site in case of necessity in an appropriate amount.

The HF remover 14 for removing HF gas in the hydrogen gas discharged from the cathode chamber 4 comprises a first remover 14*a* and a second remover 14*b* disposed in parallel. These first remover 14*a* and second remover 14*b* may be operated simultaneously, or one of them alone may be operated. This remover 14 is preferably made of an anticorrosive material resistant to HF, for example stainless steel, Monel, Ni. The inside thereof is packed with soda lime, or sodium fluoride, for instance, which removes HF passing therethrough and thereby eliminates HF from the hydrogen gas.

This HF remover 14 is disposed on the downstream side of the automatic valve 10, which is one of the constituent elements of the pressure maintenance means. A pressure reducing means 26 is disposed between this automatic valve 10 and the HF remover 14. This pressure reducing means 26 serves to place the inside of the gas line 28 in a reduced pressure condition utilizing the ejector effect of the gas passing through the gas line 27. Thus, the gas line 28 can be placed in a reduced pressure state without using any oil, hence oil invasion into the gas line and electrolytic cell 1 can be avoided.

Like the above-mentioned HF remover 14, the HF remover 15 for removing HF in the fluorine gas discharged from the anode chamber 3 comprises a first remover 15*a* and a second remover 15*b* disposed in parallel. NaF is filled in the inside of each remover and removes HF contained in the fluorine gas discharged. Like the HF remover 14, this HF remover 15 is preferably made of an anticorrosive material resistant to fluorine gas and HF, for example stainless steel, Monel, Ni or a fluororesin.

On the upstream or downstream side of this HF remover 15, there is disposed a valve, automatic valve 9, which is one the constituent elements of the pressure maintenance means. The gas generated from the anode chamber 3 is in a severe environment where HF gas is formed simultaneously with fluorine gas and splashing of the electrolytic bath occurs. The automatic valve disposed upstream of the NaF-containing absorber makes it easy to control the inside pressure in the electrolyzer. In particular, in an environment where fluorine gas and HF occur in a mixed state, a strongly oxidative atmosphere is created. When the automatic valve 9 is disposed on the downstream side of the HF remover 15, a condition in which HF-free fluorine gas alone occurs can be created and the valve can be operated or closed without being affected by HF gas. The location of the automatic valve can be appropriately selected according to plant designing. The HF remover 14 and HF remover 15 are provided with pressure gauges 30 and 29, respectively, whereby the choking in the inside can be detected upon occurrence thereof. The kind of automatic valves 9, 10 are not limited, piezo valves or mass flow controllers can be shown for example.

The fluorine gas generator comprising such electrolytic cell 1 is preferably set up within a cabinet formed of one box body (not shown). By exhausting gases with the cabinet, even if a gas leak should occur, in apparatus or piping surrounding it can be treated inside of cabinet. This is because the on-demand, on-site use of the generator is facilitated thereby. The cabinet is preferably made of a material hardly reactive with fluorine gas, for example such a metal as stainless steel or such a resin as polyvinyl chloride.

Though not shown in FIG. 1, a storage means, for example a buffer tank, is preferably disposed downstream from the side of high purity fluorine gas discharge. This makes it possible to supply fluorine gas at any time in case of necessity and in any required amount and thus provide an on-line type fluorine gas generator that can be disposed easily on any production line in a semiconductor production plant.

The anode 51 has a pressure adjusting function, namely it generates fluorine gas in small amounts when a weak electric current is fed thereto in association with the pressure gauge 7. Further, since closure of the gas outlet port and complete cutoff of voltage application during suspension of fluorine gas generation results in reversal in polarity of the anode 51 and cathode 52 and in dissolution of the cathode 52, is supplied for continuous voltage application between the anode 51 and the cathode 52 even during suspension of electrolysis. The current supply can be provided by main electrolysis source or an independent auxiliary source.

Figure 2:
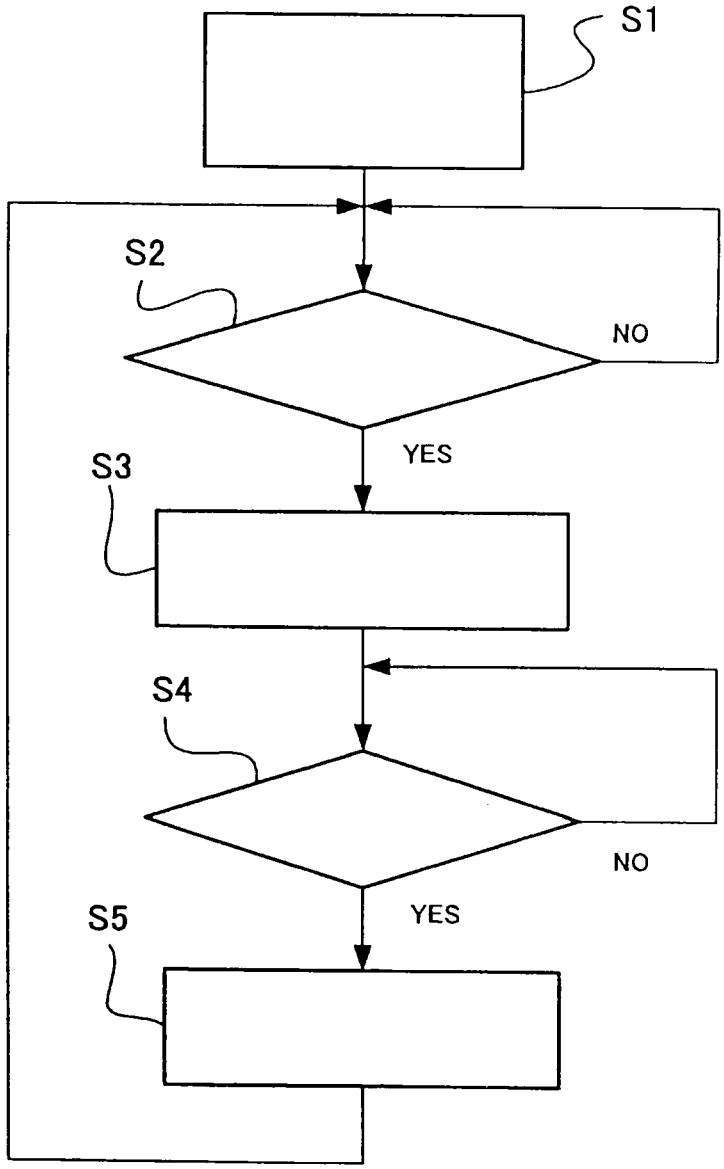
FIG. 2 is a flow chart illustrating the method of controlling the electrolytic bath liquid level in a fluorine gas generator as provided by the present invention.
Figure 3:
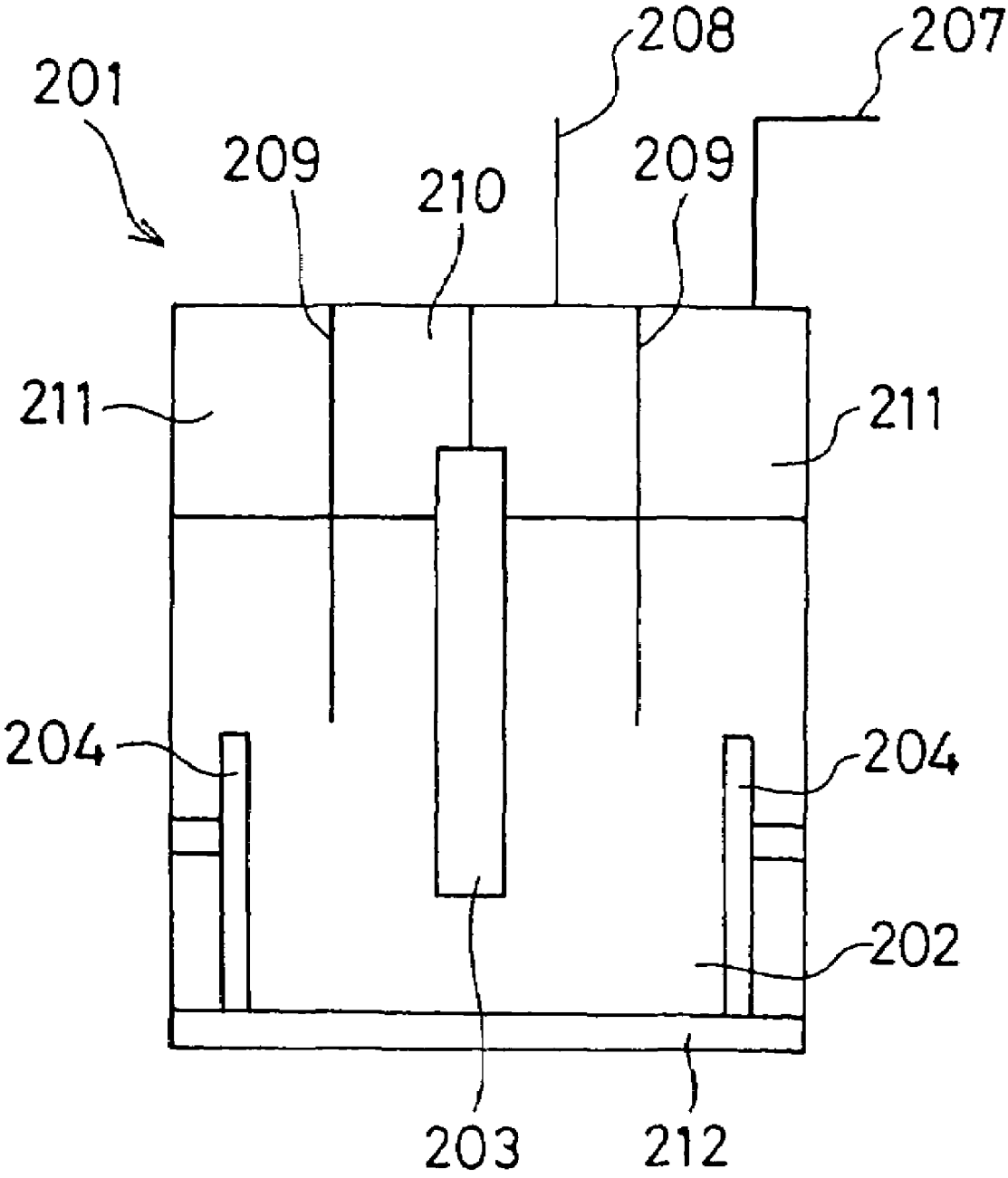
FIG. 3 is a schematic representation of a fluorine gas generator conventional in the art.

Referring to FIG. 2, the operation of such fluorine gas generator according to the above-mentioned embodiment of the invention after closure of the gas outlet ports and during suspension of fluorine gas generation is now described. FIG. 2 is a flow chart illustrating the method of controlling the electrolytic bath liquid level in a fluorine gas generator as provided by the present invention.

In a state in which electrolysis is carried out for generating fluorine gas, the inside of the electrolytic cell 1 is generally maintained at atmospheric pressure and the level of the electrolytic bath 2 in the anode chamber 3 is equal to that in the cathode chamber 4. However, when electric current supply between anode and cathode is stopped and the gas outlet 22 disposed in the anode chamber 3 is closed (step S1) for suspending fluorine gas generation at night, for instance, the fluorine gas generated from the anode 51 and retained in the anode chamber 3 go into pores of the carbon electrode used as the anode 51 and are adsorbed thereon. As a result, the pressure in the anode chamber 3 is reduced and, for balancing with the pressure in the cathode chamber 4, the electrolytic bath level in the cathode chamber 4 lowers and the electrolytic bath level in the anode chamber 3 rises. Then, in the step S2, the pressure gauge 7 for measuring the pressure in the anode chamber 3 for the purpose of controlling the electrolytic bath liquid level is detecting such change in pressure. Here, the pressure change sensing standard in the anode chamber 3 is preferably adjusted at a level of about 0 (zero) to −10 kPa relative to the pressure during fluorine gas generation. During the period during which the pressure gauge 7 does not detect such pressure change in the anode chamber 3 (S2: NO), the judgment in step S2 is continued. Upon detection of the pressure change in the anode chamber 3 by the pressure gauge 7 (S2: YES), the step S3 is started and, in association therewith, a weak electric current is supplied between anode and cathode, thus, fluorine gas is again generated in small amounts. Then, in the step S4, this weak current is supplied continuously until the original pressure in the anode chamber is restored while making a judgment as to whether the pressure gauge 7 is detecting the restoration of the pressure within the anode chamber 3 to a normal level. During the period during which the pressure gauge 7 does not detect the normal pressure in the anode chamber 3 (S4: NO), the judgment in step S4 is continued. Upon detection of the normal pressure in the anode chamber 3 by the pressure gauge 7 (S4: YES), the step S5 is started and the supply of the weak current flowing between anode and cathode is discontinued.

As described above, in the fluorine gas generator according to the above embodiment, the electrolytic bath liquid level can be controlled during suspension of fluorine gas generation by adjusting the pressure in the anode chamber through supplying a weak electric current between anode and cathode to thereby cause fluorine gas generation upon detection of a pressure change in the anode chamber by the pressure gauge and by discontinuing the weak current supply between anode and cathode upon restoration of the pressure in the anode chamber to a normal level. In this way, it is possible to accurately control the electrolytic bath liquid level by detecting a slight change in electrolytic bath liquid level through detection of a change in pressure. Therefore, the electrolysis for fluorine gas generation can be restarted with ease and, at the same time, the condition in the anode chamber can be monitored, which enables safe operation.

The fluorine gas generator according to the invention is not limited to the embodiment described above but may include the following modifications, for instance.

Alternatively, the pressure change in the anode chamber may be detected indirectly by detecting the pressure change in the cathode chamber, not directly detecting the pressure change in the anode chamber. Further, a sensor directly detecting the level of the electrolytic bath surface, for example a noncontact type range finder, may be used in lieu of the pressure gauge. Further, in controlling the electrolytic bath liquid level in the electrolyzer after closure of the gas outlet port in the anode chamber and during suspension of fluorine gas generation, a threshold value may be employed for the pressure in the anode chamber and the value of the current to be supplied to the anode may also be selected in advance at a certain level for simple on-off controlling. It is also possible to monitor pressure change-due deviations to thereby vary the current quantity to be supplied to the anode according to the deviations.

In accordance with the present invention, which has the constitution described above, a fluorine gas generator can be provided in which the electrolytic bath liquid level in the electrolyzer can be controlled even after closure of the gas outlet port in the anode change in the fluorine gas generator and during suspension of fluorine gas generation and which can be safely operated.

What is claimed is:

1. A fluorine gas generator for generating fluorine gas by electrolyzing an electrolytic bath including hydrogen fluoride and a mixed molten salt, comprising:

an anode chamber including an anode;

a cathode chamber including a cathode;

a partition wall separating the anode chamber and the cathode chamber;

an electrolytic bath liquid level control device configured to control a height of electrolytic bath liquid level in at least one of the anode chamber and the cathode chamber during suspension of fluorine gas generation; and said electrolytic bath liquid level control device including an electric supply for supply of an electrolysis current between the anode and cathode during the electrolyzing and for supply of a maintenance current smaller than the electrolysis current between the anode and cathode during suspension of fluorine gas discharge from the fluorine gas generator to maintain the height of the electrolytic bath liquid level by pressure adjustment in the anode chamber, wherein the electrolytic bath liquid level control device comprises a pressure sensor, and a pressure controller operated in association with the pressure sensor and configured to control the pressure in the anode chamber in order to control the difference of the liquid level in the anode chamber and the cathode chamber.

2. A method of controlling electrolytic bath liquid level in a fluorine gas generator having an anode chamber including an anode and a cathode chamber including a cathode separated from each other by a partition wall for generating fluorine gas by electrolyzing an electrolytic bath having a hydrogen fluoride-containing mixed molten salt, comprising:

detecting the pressure in at least one of the anode chamber and the cathode chamber, during suspension of fluorine gas discharging from the fluorine gas generator, by a pressure sensor; and supplying, according to the result of detection by the pressure sensing means sensor, a maintenance electric current between the anode and the cathode for generation of a requisite amount of fluorine gas to thereby adjust the pressure in the anode chamber and to control the difference of the electrolytic bath liquid level in the anode chamber and cathode chamber during suspension of fluorine gas discharging from the fluorine gas generator.

* * * * *